US005794710A

United States Patent [19]

Maxwell

[11] Patent Number: 5,794,710

[45] Date of Patent: Aug. 18, 1998

[54] LIGHTWEIGHT ADJUSTABLE TRACK "POWER DOZER"

[76] Inventor: Grant D. Maxwell, P.O. Box 816, Viking, Alberta, Canada, T0B 4N0

[21] Appl. No.: 665,221

[22] Filed: Jun. 14, 1996

[51] Int. Cl.[6] ..... E02F 5/02; E02F 5/22

[52] U.S. Cl. ..... 172/33; 172/66; 37/142.5; 37/374

[58] Field of Search ..... 172/33, 63, 66; 37/142.5, 374, 375, 376

[56] References Cited

U.S. PATENT DOCUMENTS

| | | | |
|---|---|---|---|
| 3,744,568 | 7/1973 | Beyers et al. | 172/33 |
| 3,777,822 | 12/1973 | Stedman et al. | 172/33 |
| 4,200,408 | 4/1980 | Babler et al. | 37/376 X |
| 4,358,905 | 11/1982 | Maxwell | 172/33 X |
| 4,377,365 | 3/1983 | Layh | 37/142.5 X |
| 4,827,637 | 5/1989 | Kahlbacher | 172/33 X |

*Primary Examiner*—Terry Lee Melius

*Assistant Examiner*—Christopher J. Novosad

*Attorney, Agent, or Firm*—Seed and Berry LLP

[57] ABSTRACT

This invention is directed to a lightweight adjustable track earth moving device. More particularly this invention is directed to an improved efficient light-weight adjustable track earth moving device which can be attached at the front end of an endless track vehicle and used for efficiently moving earth from one location to another, for example, into a ditch or excavation. Apparatus for moving earth comprising: (a) a vehicle; (b) earth contacting member mounted on the vehicle for moving earth in one direction; (c) a reversible horizontally travelling endless track earth moving member mounted in association with the earth contacting member for moving earth lateral to the one direction; (d) a first and second independent direct drive member driving the endless track earth moving member; and (e) alignment adjusting member located inside the endless track earth moving member and controllable from outside the endless track earth moving member for adjusting the alignment of the first independent direct drive member to conform with the alignment of the second independent direct drive member.

16 Claims, 11 Drawing Sheets

LIGHTWEIGHT ADJUSTABLE TRACK "POWER DOZER"

FIELD OF THE INVENTION

This invention is directed to a lightweight adjustable track earth moving device. More particularly, this invention is directed to an improved efficient light-weight adjustable track earth moving device which can be attached at the front end of and endless track vehicle and used for efficiently moving earth from one location to another, for example, into a ditch or excavation.

BACKGROUND OF THE INVENTION

Returning earth efficiently and quickly from one location to another, for instance, into an excavation from which the earth has been removed has been a problem of long standing in the earth moving field. Many machines have been designed to handle this problem. Various machines have solved the problem with only varying degrees of success.

A particularly troublesome problem, which has not been successfully solved in the past, is returning removed earth back into a long ditch into which an oil or gas transmitting pipeline has been laid. In a pipeline laying application, using modern pipe laying methods, a long cleanly cut ditch is excavated across the countryside. After this, the pipeline is laid in the ditch. It is subsequently buried with the earth that has been removed from the ditch. When the ditch for the pipeline is being excavated, the removed earth is piled in a relatively neat elongated ridge alongside the ditch. If conventional earth moving equipment is used, such as a conventional dozer with a front blade, it is difficult, without encountering considerable waste motion and time, to replace the removed earth in the ditch. When an endless track vehicle, commonly known as a dozer, with an angled front blade, is used the earth has a tendency to pile up and spill around both ends of the blade. The result is that at least two passes with the dozer blades, and frequently more, must be made in order to move all the earth or to fill the ditch.

A straight dozer blade also has a tendency to undesirably compact the earth and move boulders and large earth lumps to the front, which, when they drop into the ditch can cause damage to the protective coating on the pipe lying at the bottom of the ditch. Earth moving augers are also used for moving earth back into ditches, but they are less than completely successful for similar reasons.

The crude oil carrying pipeline laying situations, it is often necessary to lay the pipeline in a right-of-way the is parallel to a crude oil or natural gas carrying pipeline that is an adjacent right-of-way. In this situation, it is important that none of the earth that is excavated for the second pipeline ditch is deposited on the right-of-way of the first laid pipeline. This is because the weight of heavy earth moving equipment on the ground above the first laid pipeline can cause damage to the underlying first laid pipeline. It is difficult for conventional dozer, and the like, to deal with this problem because earth always tends to spill by both sides of the conventional dozer blade.

Another earth moving problem is stripping and retaining valuable top soil from a right-of-way. Often this must be done in very restricted widths, and the soil must not spill over onto the land adjoining the right-of-way. This is an increasingly common problem, for example, in subdivision areas, in areas where there are easements over densely occupied land, and the like. An earth moving contractor can expose himself to a law suit by spilling earth onto privately owned land, particularly if damage is caused in removing the earth from the privately owned land.

Another problem that has become increasingly significant in recent years is concern with the ecology. Regulatory authorities, in response to this concern, whenever pipelines and the like are installed across the country, have required, among other things, that the terrain be returned to its original condition. This means that valuable excavated top soil must be kept on the surface and returned to its approximate original location in fundamentally the same state as when it was removed. Fulfilling this requirement is time consuming and expensive. It often represents difficult work for conventional earth moving equipment because considerable time and numerous traverses of the equipment are required, all of which translate into considerable expense.

To deal with and overcome the foregoing problems, my father, Donald Maxwell, decease, invented a unique earth moving attachment which can be secured to a typical endless track vehicle and used for quickly and efficiently moving excavated earth from one position to another. The attachment is disclosed and claimed in U.S. Pat. No. 4,358,905, Nov. 16, 1982. The apparatus for moving earth, identified with the trade-mark "Power Dozer", comprised (a) and earth contacting blade; (b) a horizontal endless track mounted in association with the earth contacting blade for moving the earth in a direction lateral to the direction of travel of the earth contacting blade; and (c) a vehicle for moving the blade and the endless track in cooperation with one another. The method of using the "Power Dozer" involved advancing the vehicle and the earth moving blade through a continuous longitudinal ridge of earth in a manner such that the speed of advancement of the vehicle and the earth contacting blade is synchronized with the speed of movement of the laterally travelling earth moving endless track. In this way, essentially all of the earth is moved laterally in the direction of travel of the laterally travelling earth moving track, and none spills around the "top" end of the blade and endless track.

The "Power Dozer" has been widely used in industry, particularly in pipeline laying environments, and has been shown, when posturing the conveyer dozer blade at a 45° angle to the direction of travel, to have an efficiency of about 65 percent in moving earth compared to an efficiency of 35 percent for a conventional Caterpillar D9 with a conventional straight dozer blade angle set at 45°. The "Power Dozer" has been demonstrated to move more cubic yards of dirt per horsepower per hour than a straight dozer using a conventional blade.

The "Power Dozer", despite its may advantages, has some shortcomings. One problem with the "Power Dozer", has been that with a series of five driving motors (see FIG. 5 of U.S. Pat. No. 4,358,905), and an endless track, with reinforcement the weight of the "Power Dozer" blade is considerable. Another problem is that with limited contact between the sprockets of the three middle motors and the upper and lower track chains which carry the horizontal endless track, considerable sprocket wear takes place. As a consequence, only about 600 hours of use can be obtained from the sprockets on the middle set of motors, compared to an industry average of about 3,000 use hours per sprocket. A third problem is that since considerable lateral torque forces are involved in driving the horizontally disposed endless track on the "Power Dozer", the five drive motors, and particularly the two end motors, tended to gradually move out of alignment with one another. Ideally, all five drive motors should be parallel with one another and rotate at the same speed. Because of the tremendous forces involved, the end motors particularly tend to become misaligned and sprockets on the end motors tend to gradually move out of synchronization with the upper and lower drive chains. As a consequence, periodic position adjustment of the drive motors is required. This is a time consuming job because the endless horizontal track on the "Power Dozer" has to be removed, and considerable measuring and position adjusting of the drive motors must be made in order to return them to "square" alignment with one another. This adjustment procedure can take from one-half to a full day of expensive down time. While being adjusted, the "Power Dozer" holds up other jobs, especially in pipeline laying situations, and considerable expense in down time in incurred.

SUMMARY OF THE INVENTION

The invention is directed to an apparatus for moving earth comprising: (a) a vehicle; (b) earth contacting means mounted on said vehicle for moving earth in one direction; (c) a reversible horizontally travelling endless track earth moving means for moving earth lateral to said one direction; (d) a first and a second independent direct drive means driving said endless track earth moving means; and (e) alignment adjusting means located inside the endless track earth moving means and controllable form outside the endless track earth moving means for adjusting the alignment of the second independent direct drive means.

The alignment adjusting means can comprise means associated with the first direct drive means, connected to an upper or a lower region of said first direct drive means for moving the upper or lower region of the first direct drive means relative to the second direct drive means.

the alignment adjustment means can include a second means associated with the first reversible direct drive means connected to an upper or lower region of the first direct drive means for moving the upper or lower region of the first direct drive means relative to the second direct drive means.

The alignment adjustment means can include an extension means associated with the second direct drive means, whereby when the second extension means is activated, the second direct drive means can be moved relative to the first direct drive means. The extension means can be connected to a lower region of the second direct drive means and a second extension means can be connected to an upper region of the second direct drive means.

The alignment adjustment means can comprise a first hydraulic cylinder which can be secured at one end to a frame of the earth moving means and a second end can be connected to the first direct drive means.

The alignment adjustment means can include a second hydraulic cylinder, the first hydraulic cylinder being extensibly and contractionally connected to a lower region of the first direct drive means and the second hydraulic cylinder being extensibly and contractionally connected to an upper region of the first direct drive means.

The base of the first reversible direct drive means can be associated with a drive means mounting means which can be moved from a first position to a second position. A first end of the drive means mounting means can be pivotally connected to a frame of the endless track earth moving means and a second end of the mounting means can be free and movable in association with a guide means connected to the frame.

The horizontally travelling endless track earth moving means can present a substantially vertical face to the direction of horizontal advancement of the vehicle and can move in a horizontal direction lateral to the direction of travel of the vehicle.

The apparatus can include rotational restraining means for holding said endless track earth moving means in driving engagement with the first and second direct drive means.

The endless track earth moving means can be constructed of a plurality of vertical plates connected to upper and lower endless chains, which can engage with and travel in upper and lower sprockets on the first and second direct drive means. The plurality of vertical plates can be formed of elongated extruded aluminum.

The apparatus can include a second alignment adjustment means. The second alignment adjusting means can be associated with the second direct drive means and can move the second direct drive means relative to the first direct drive means.

BRIEF DESCRIPTION OF THE DRAWINGS

In drawings which illustrate specific embodiments of the invention, but which should not be construed as restricting the spirit of scope of the invention in any way.

DETAILED DESCRIPTION OF SPECIFIC EMBODIMENTS OF THE INVENTION

Figure 1:
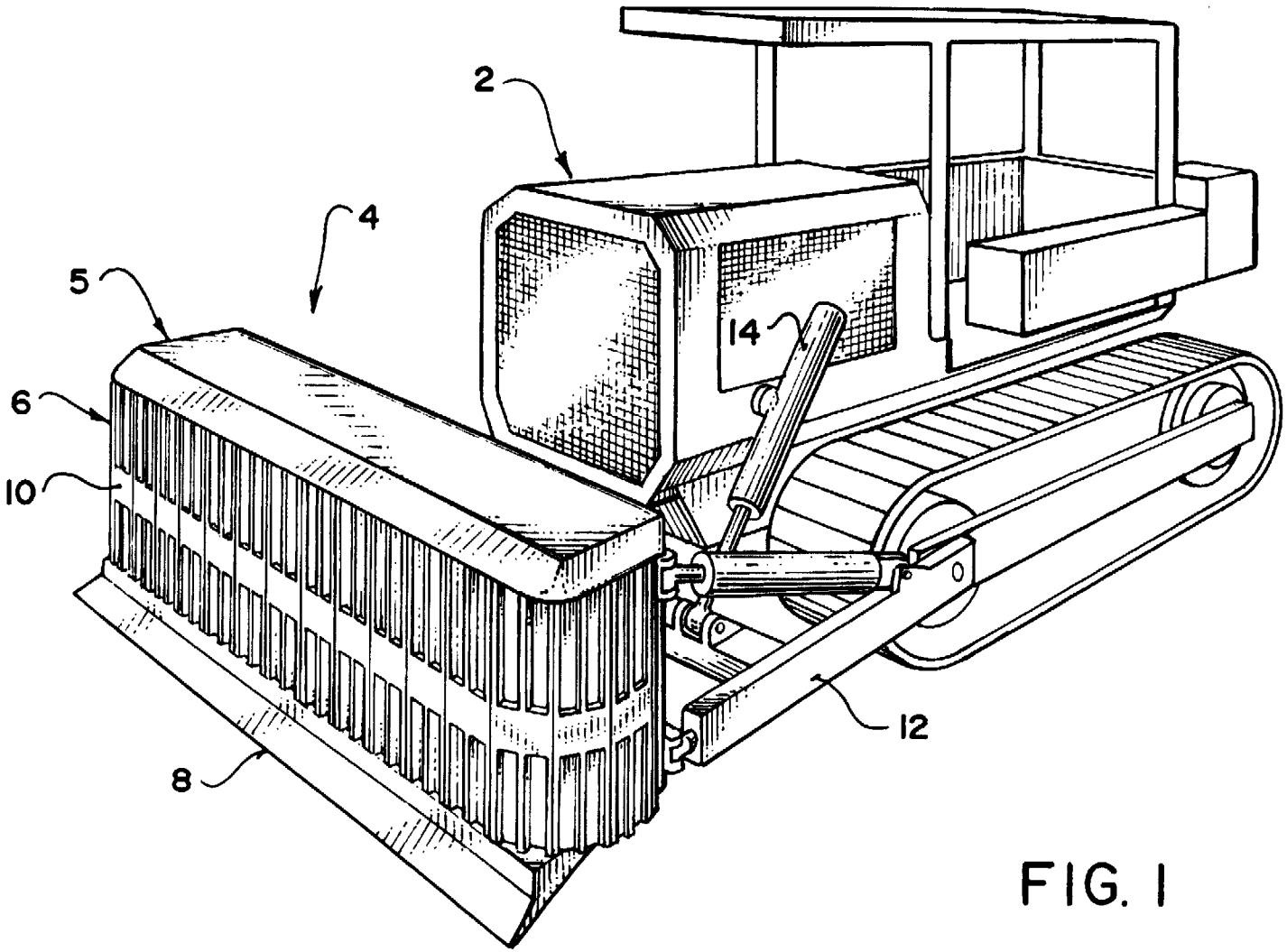
FIG. 1 illustrates and isometric view of the improved lightweight adjustable track "Power Dozer".

Referring to the drawings, FIG. 1 illustrates an isometric view of the lightweight adjustable track "Power Dozer". As seen in FIG. 1, the earth moving track blade 4, termed a "Power Dozer", is mounted on a conventional endless track tractor 2 by means of a pair of blade support arms 12, one on each side of the tractor 2. The two blade support arms 12 are controlled by a respective pair of blade lifting hydraulic cylinders 14, one on each side of the tractor 2.

The earth moving track blade 4 has movably and horizontally mounted thereon, around the front, back and sides of the earth moving track blade 4, a horizontal endless track 6. An earth scraper blade 8 is affixed to the front bottom horizontal edge of the blade 4 below the horizontal track 6. A series of idler wheels, which are not visible in FIG. 1, are arranged horizontally at the rear face of the endless horizontal track 6. These idler wheels keep the rear face of the endless horizontal track from bowing or flaring rearwardly when the track is in motion. In order to provide a smooth path of travel for the idler wheels, a horizontal series of idler wheel insets 10 are mounted around the track 6 between the lugs of the horizontal endless track 6, at a mid-point elevation.

Figure 2:
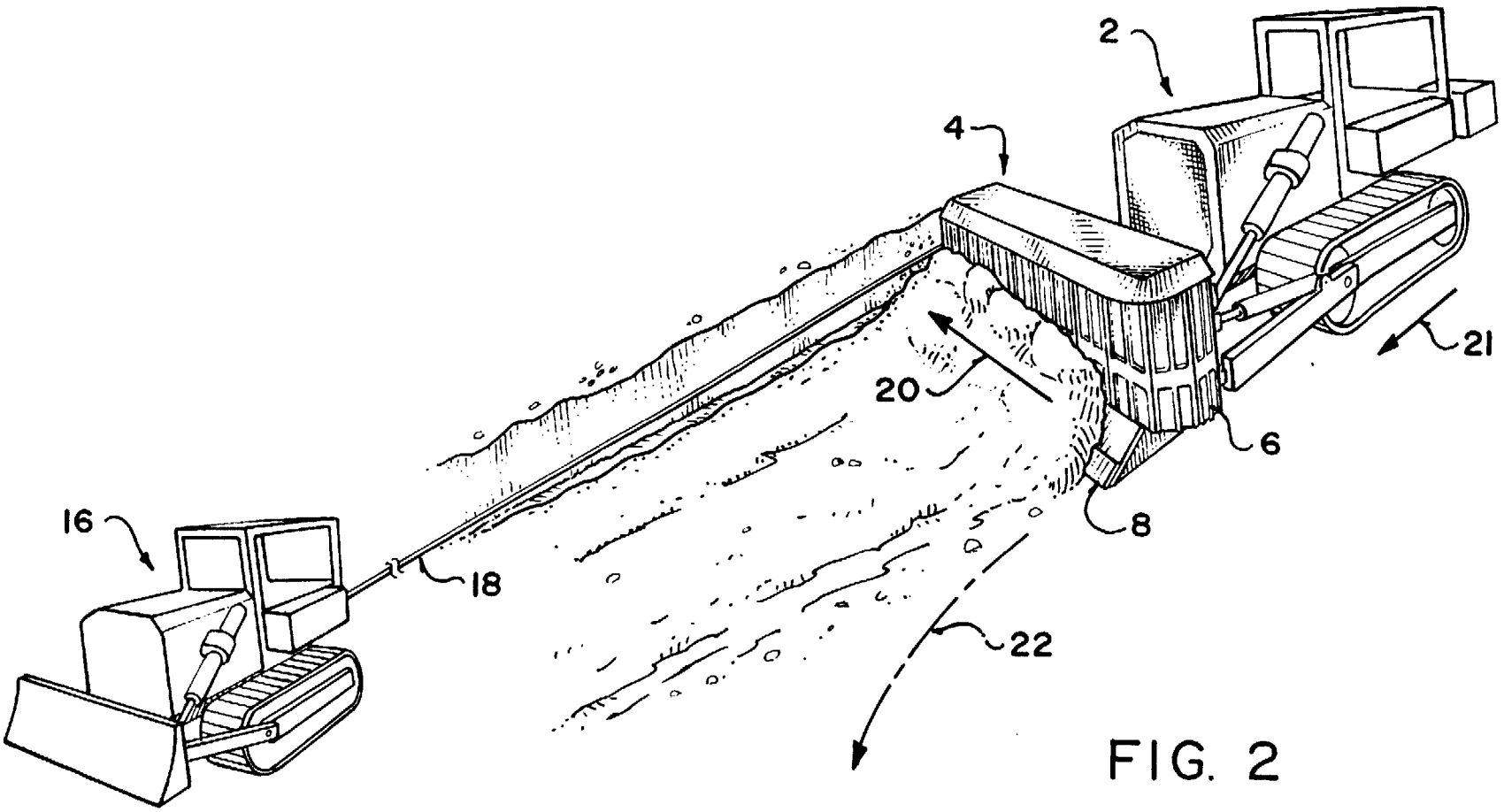
FIG. 2 illustrates an isometric view of the improved lightweight adjustable track "Power Dozer" returning earth into an elongated ditch, the "Power Dozer" being towed by an auxiliary endless track tractor.

FIG. 2 illustrates an isometric view of the lightweight adjustable track "Power Dozer" 2,4 in operation laterally moving earth into a ditch, the direction of which is indicated by arrow 20. The endless horizontal track 6 is moving in the same direction of arrow 20. The tractor 2 is moving forwardly in the direction of arrow 21. The blade 8 scoops the earth up from the under burden, and onto the laterally moving endless track 6.

As seen in FIG. 2, it has been found that the tractor 2 and earth moving track blade 4,6 when moving heavy earth laterally to one side as indicated by arrow 20, tend to endeavour to proceed in a curve away from the ditch. The attempted direction of movement of the tractor 2 and blade 4,6 is indicated by dotted arrow 22. An obvious way to offset this tendency of the tractor 2 and blade 4,6 to attempt to move along the path of dotted arrow 22 is to continuously steer the tractor 2 towards the ditch. However, this action provides a drag on the pair of endless tracks of the tractor 2 and there is friction and some slippage. This results in reduced performance and increased power consumption. I have found that efficiencies can be improved considerably if the tractor 2 and earth moving track blade 4,6 are towed by an auxiliary towing tractor 16, by means of a towing cable 18, which is secured between the rear end of the towing tractor 16, and the forward end of the earth moving track blade 4,6. I have found that by using this method, efficiencies have been increased as much as 50 percent. Normally, a conventional "Power Dozer" can outperform a conventional D9 Caterpillar dozer with straight blade 2 to 1. However, with the lightweight adjustable track "Power Dozer" of the invention, using a towing tractor 16 and towing cable 18, as much earth can be moved in an hour as can be moved by three conventional Caterpillar D9 tractors equipped with conventional dozer blades.

Figure 3A:
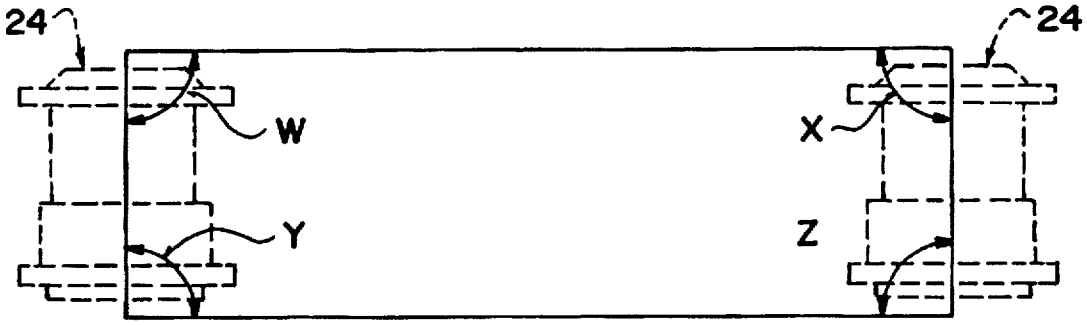
FIG. 3*a* illustrates a schematic view of proper rectangular alignment for a pair of sprocket drives for the lightweight adjustable track "Power Dozer".

FIG. 3*a* illustrates a schematic view of proper rectangular alignment for a pair of sprocket drives for the lightweight adjustable track "Power Dozer". As seen in FIG. 32, the pair of drive sprockets 24 are parallel and at the same elevation with one another. This is the ideal configuration and in such a case, the angles denoted by w, x, y and z are equal and are right angles.

Figure 3B:
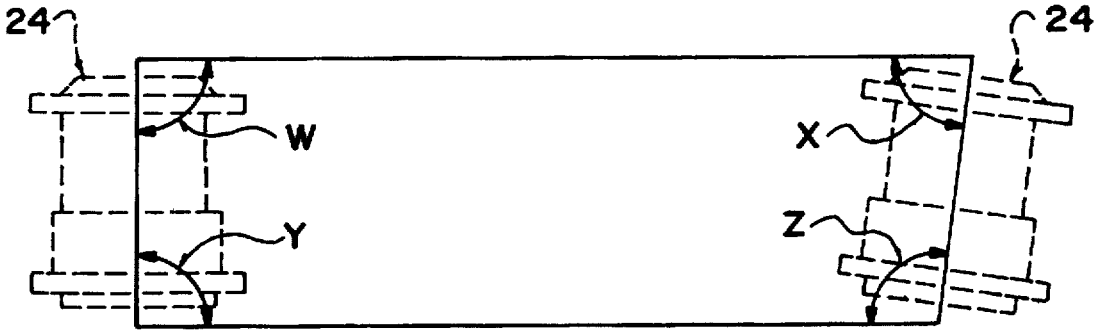
FIG. 3*b* illustrates a schematic view of a situation where the right hand sprocket drive has moved out of rectangular alignment with the left hand sprocket drive of the "Power Dozer".

FIG. 3*b* illustrates a schematic view of a situation where the right hand drive sprocket 24 has moved out of alignment with the left hand drive sprocket 24. The right hand drive sprocket 24 is tilted to the side and angles x and z are unequal.

Figure 3C:
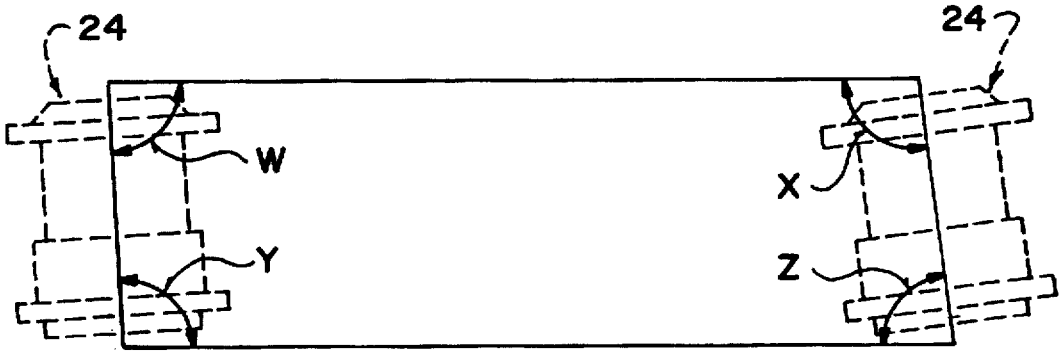
FIG. 3*c* illustrated a schematic view of a situation where both the right hand and left hand sprocket drives of the "Power Dozer" have moved out of rectangular alignment with one another.

FIG. 3*c* illustrates a schematic view of a situation where both the left hand and right hand drive sprockets of the "Power Dozer" have moved out of square alignment with one another. In this case, none of the angles w, x, y, z agree with each other.

In the situations illustrated in FIGS. 3*b* and 3*c*, the two drive sprockets 24 do not synchronize with one another, and the endless chain drives of the horizontal track 6 do not mesh properly with the sprockets and excessive wear and improper function result.

Figure 4:
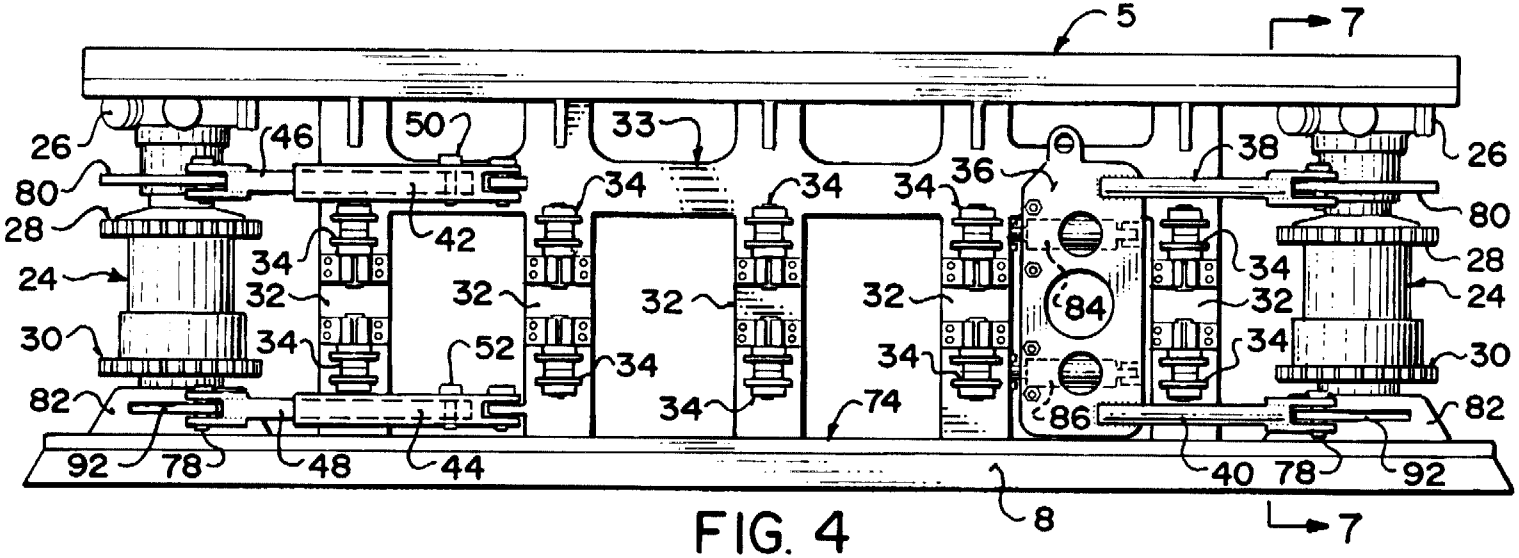
FIG. 4 illustrates a cut-away front view of the lightweight adjustable track "Power Dozer".

FIG. 4 illustrates a cut-away front view of the lightweight adjustable track "Power Dozer". As seen in FIG. 4, the lightweight adjustable track"Power Dozer" has at each side a sprocket drive 24, driven by a respective motor 26. As seen in FIG. 4, one sprocket drive 24 is mounted at the right end, while the other sprocket drive 24 is mounted at the left end. In the view illustrated in FIG. 4, the horizontal endless track 6 has been stripped away to expose the internal mechanisms of the lightweight adjustable track of the invention. Each sprocket drive 24 has mounted around the horizontal circumference thereof an upper horizontal sprocket 28 and a parallel lower horizontal sprocket 30. The upper sprocket 28 and the lower sprocket 30 respectively mesh with and carry upper and lower chain drives, which are not visible in FIG. 4 since the track 6 in stripped away, but which are visible in FIG. 6. A protective cowling 5 covers the top length of the "Power Dozer".

The pair of sprocket drives 24 and respective motors 26 are vertically and rotationally mounted in combination with a vertical support frame 32, an upper frame 33 and a lower frame 74. The frame 32, 33 and 74 is constructed of steel and the components thereof welded together. Alternatively, the vertical support frame 32 and upper frame 33 and lower frame 74 can be bolted together. As seen in FIG. 4, there are five vertical support frames 32 spatially disposed parallel to one another in series between the pair of sprocket drives 24 and motors 26 and the upper frame 33 and lower frame 74. Upper and lower idler wheels 34 are rotationally mounted on each of the five vertical support frames 32. The upper and lower idler wheels 34 are disposed in series in horizontal alignment with the respective upper and lower sprockets 28 and 30. The idler wheels 34 are of conventional construction and in company with the respective upper and lower sprockets 28 and 30 of the left and right sprocket drives 24, carry the endless upper track chain 64 (see FIG. 6) and a corresponding lower track chain, affix to the upper and lower positions of the interior of the horizontal track 6 (see FIG. 1).

Referring to the first sprocket drive 24 and motor 26, as shown on the right side of FIG. 4, the upper and lower ends of the sprocket drive 24 are connected to upper adjustment arm 38 and lower adjustment arm 40. Upper adjustment arm 38 and lower adjustment arm 40 are movably and detachably connected to the sprocket drive 24 at points above the upper sprocket 28 and below the lower sprocket 30. The vertical axial disposition of the sprocket drive 24 and motor 26 can be adjusted by means of a stationary hydraulic mount plate 36 (slidably connected to the upper frame 33) to which the upper adjustment arm 38 and the lower adjustment arm 40 are affixed. The manner in which the vertical axial disposition of the drive 24 and motor 26 can be adjusted will be explained in greater detail below in association with FIGS. 9, 10, 11, 12 and 13.

Referring to the second sprocket drive 24 and motor 26, shown at the left of FIG. 4, the vertical axis of the second sprocket drive 24 and motor 26 is also adjustable by means of an upper telescope adjustment arm 42 and a lower telescope adjustment arm 44. The end of the upper adjustment arm 42 opposite the sprocket drive 24 is secured to the upper support frame 33. The end of the lower adjustment arm 44 opposite the sprocket drive 24 is secured to the vertical support frame 32. The opposite ends of the adjustment arms 42 and 44, that is, the left end as seen in FIG. 4, have respectively telescopically disposed therein upper telescope extension arm 46 and lower telescope extension arm 48. The position of the upper telescope extension are 46 can be adjusted with respect to upper telescope adjustment arm 42 by means of a removable upper set pin 50. Likewise, the position of the lower telescope extension arm 48 can be adjusted telescopically in association with lower telescope adjustment arm 44 by means of removable lower set pin 52. The free ends (the left ends as seen in FIG. 4) of the upper telescope extension arm 46 and lower telescope extension arm 48 are detachably connected to the second sprocket drive 24 and motor 26, the first at a point above upper sprocket 28 and the lower at a point below lower sprocket 30.

As seen in FIG. 4, the upper frame 33 and the hydraulic mount plate 36 have weight reducing holes formed therein.

Figure 5:
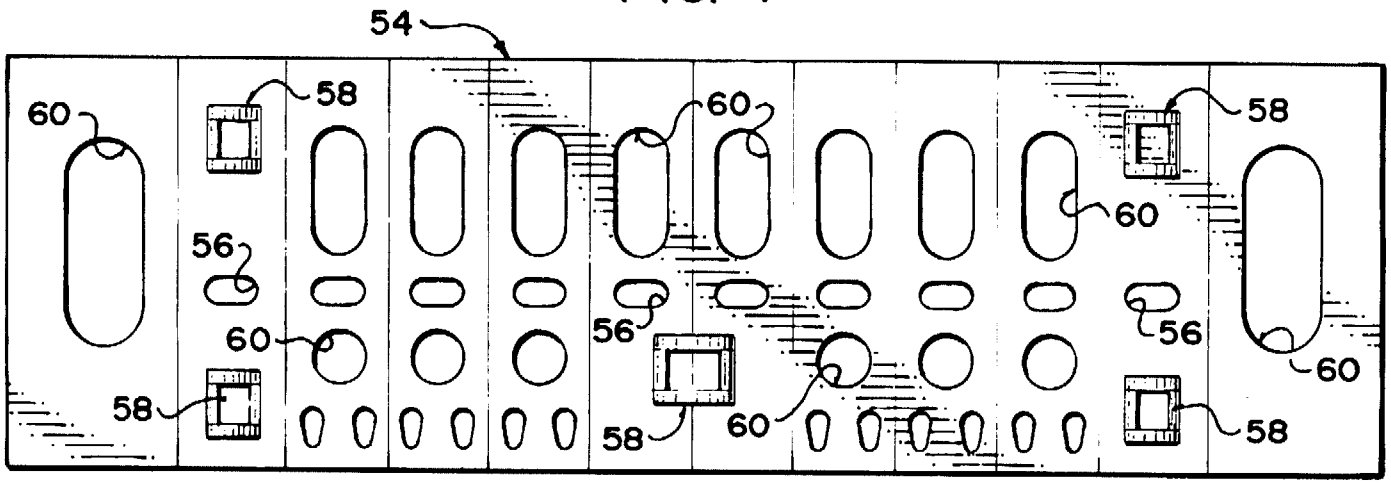
FIG. 5 illustrates a rear view of the back place of the lightweight adjustable track "Power Dozer".

FIG. 5 illustrates a rear view of the back plate or rear frame 54, of the lightweight adjustable track "Power Dozer". As seen in FIG. 5, the rear frame 54, which can be constructed of bolted or welded steel plate, has therein a horizontal series of spaced rear track guide wheel openings 56. These openings 56 are necessary to enable the mounting and rotation of rear idler 68, which will be discussed later in association with FIG. 6. A series of access and weight reducing openings 60 are also formed in the rear frame 54. These openings 60 reduce the overall weight of the rear frame 54, without seriously detracting from the overall strength of the rear frame 54. Five tractor mounts 58 are also secured to the rear face of the rear frame 54 at appropriate locations. These tractor mounts 58 are adapted to be detachably connected to the blade support arms 12 of a conventional tractor 2, as seen in FIG. 1.

Figure 6:
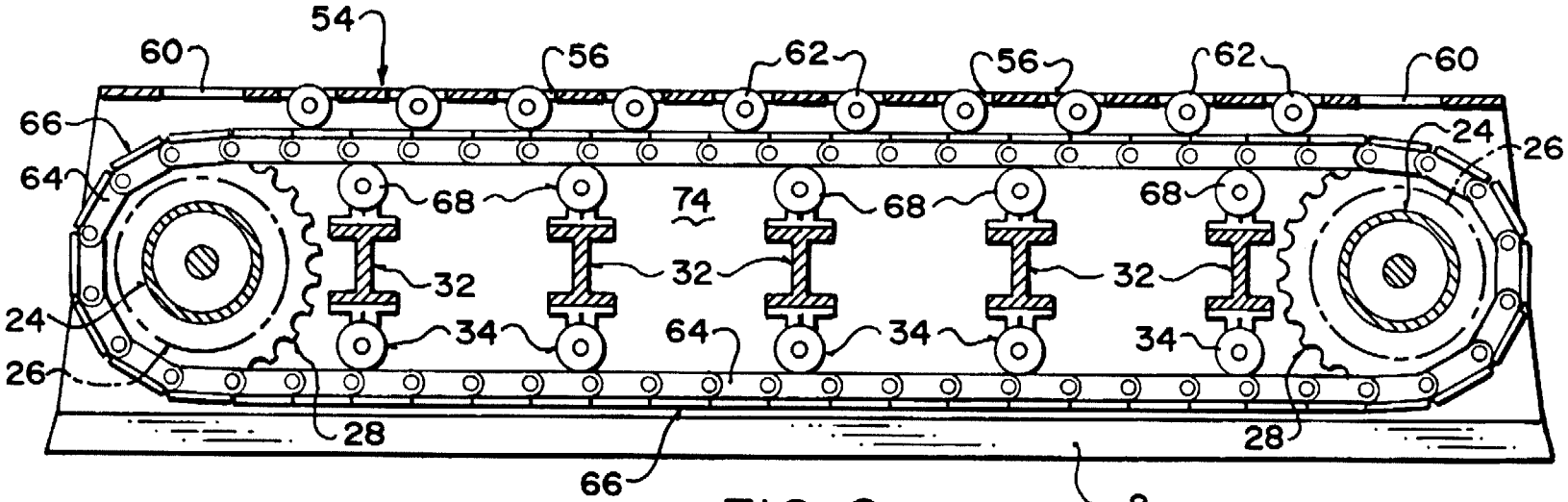
FIG. 6 illustrates a cut-away side view of the lightweight adjustable blade "Power Dozer".

FIG. 6 illustrates a cut-away top view of the lightweight adjustable blade "Power Dozer". As seen in FIG. 6, a series of rotating rear track guide wheels 62 are disposed along the length of rear frame 54. As explained previously in association with FIG. 5, the rear track guide wheels 62 rotate in openings 56 formed in rear frame 54. As can also be seen in FIG. 6, upper track chain 64, constructed of a series of rotationally interlinked track elements, mesh with and travel in the outer circumference of upper sprockets 28 of the right and left sprocket drives 24, with the respective drive motors 26 mounted on the top thereof. The rear of the front side of the endless upper track chain 64 (the lower side as seen in FIG. 6), in the portion that travels between the right and left upper sprockets 28, is rotationally held and guided by the series of five spatially disposed front idler wheels 34. As seen in FIG. 6, the front idlers 34 are rotationally mounted on vertical support frames 32. The exterior rear side (the upper side as seen in FIG. 6), of the endless upper track chain 64, between the left and right upper sprockets 28, is held by and travels along a series of five rotation rear idlers 68. The rear side of track chain 64, adjacent the back frame 56, is held in position, and prevented from "flaring" or "bowing" due to centrifugal force, by travelling in the apace provided between the series of five rear idlers 68, and the series of ten rear track guide wheels 62.

Figure 7:
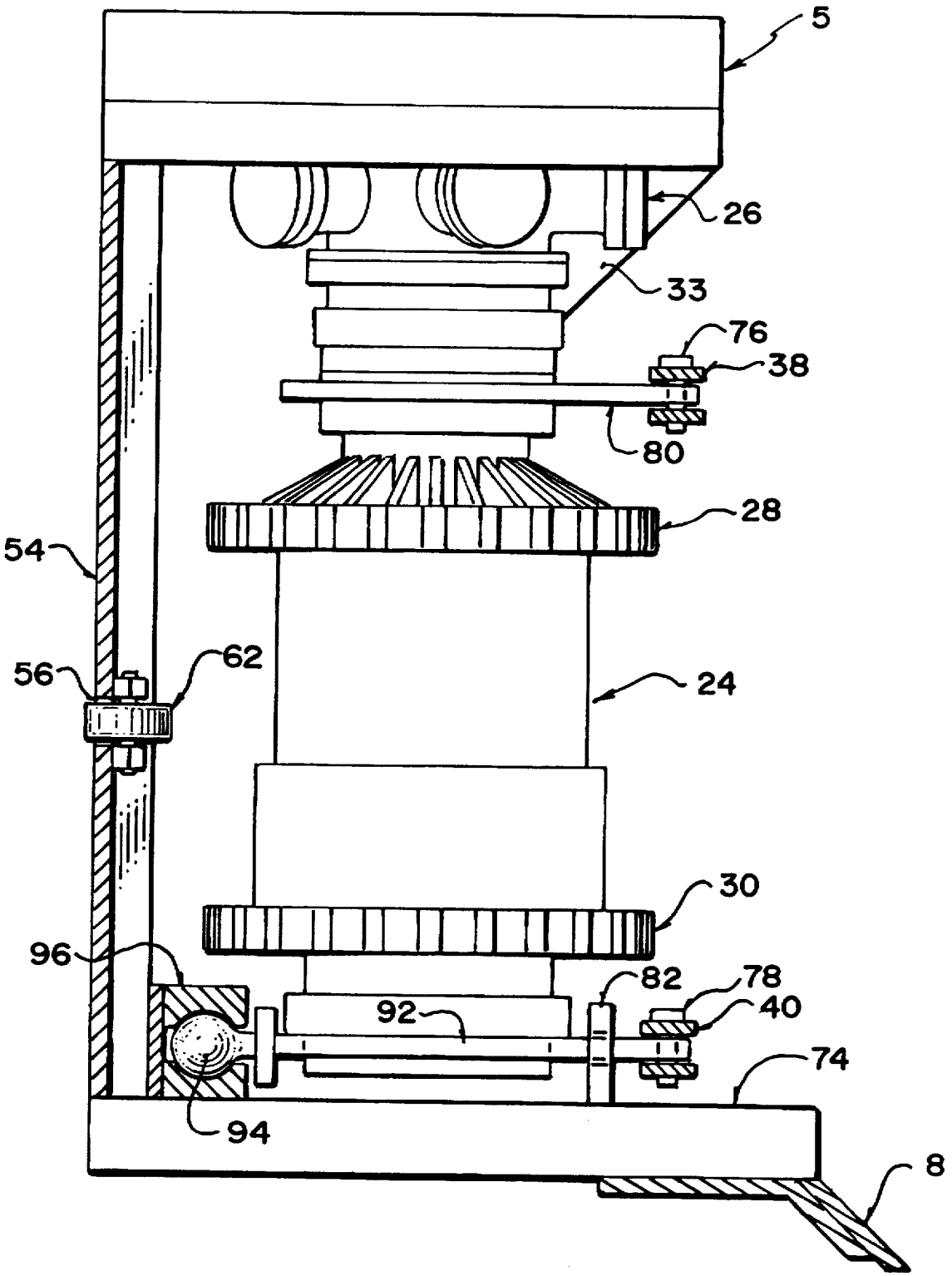
FIG. 7 illustrates a cut-away side view taken along section line 7—7 of FIG. 4 of the lightweight adjustable blade "Power Dozer", and one of the drive motors.

FIG. 7 illustrates a cut-away side view, taken along section line 7—7 of FIG. 4, of the lightweight adjustable blade "Power Dozer". As seen in FIG. 7, the motor 26 and underlying sprocket drive 24 are vertically and axially disposed in the space provided underneath top protective cowling 5, and above bed frame 74. The bed frame 74 is constructed of steel and is welded or bolted to other components of the frame, including rear frame 54 (and vertical support frame 32 and upper frame 33, which are not visible in FIG. 7, but see FIG. 4). As seen in FIG. 7, the horizontal position of the upper end of sprocket drive 24, that is, above upper sprocket 28 and below motor 26, is controlled by upper adjustable arm 38 (see also FIG. 4). Likewise, the lower horizontal position of the sprocket drive 24, below lower sprocket 30 and above bed frame 74, is controlled by lower adjustment arm 40.

Also visible in FIG. 7 are rear track guide wheel 62 and lower adjustable drive mount plate 92, ball swivel 94 and slide guide 82, which enable the base of the sprocket drive 24 to be moved by lower adjustment arm 40, as will be explained in more detail below in association with FIG. 9, 10, 11, 12, and 13.

Figure 8:
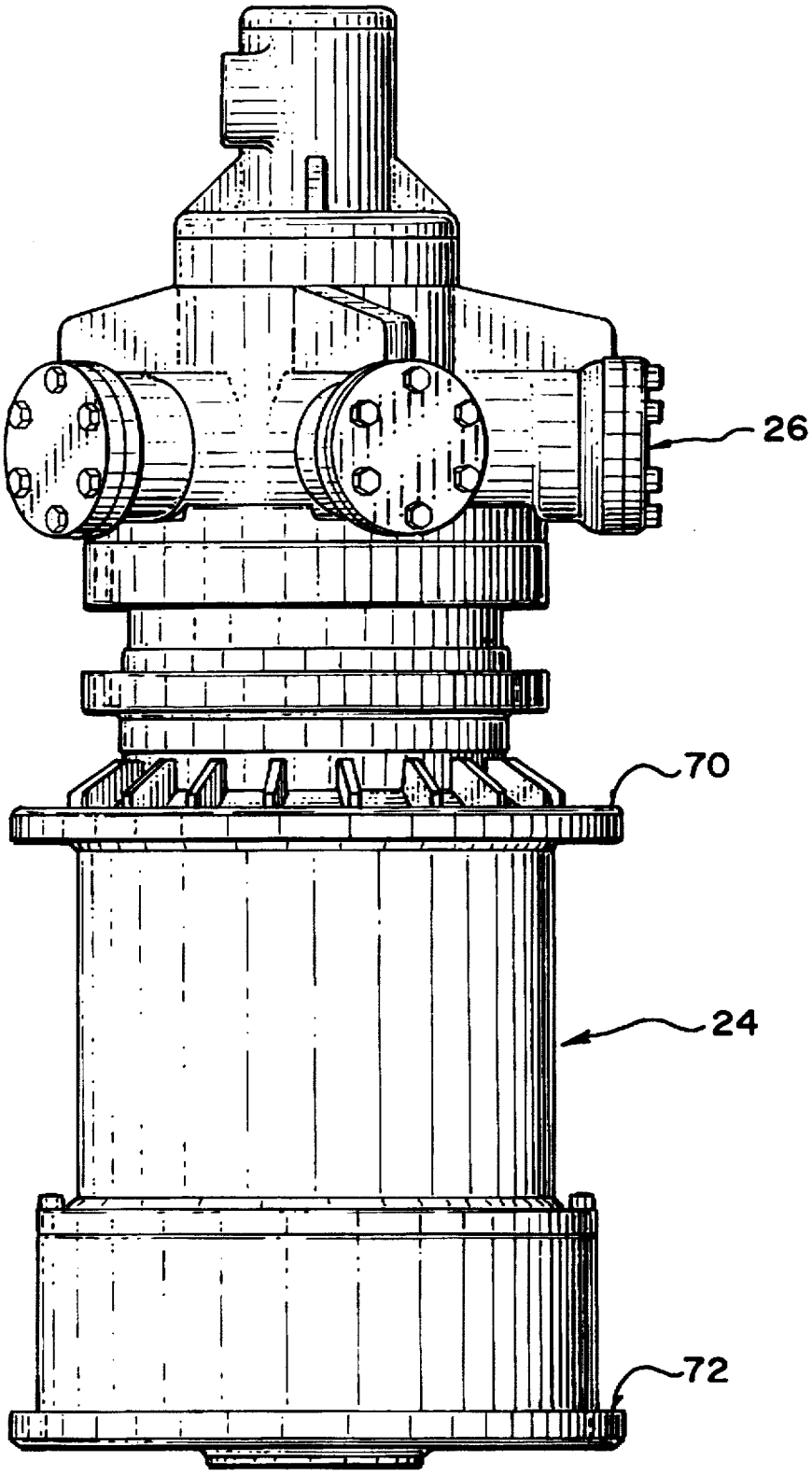
FIG. 8 illustrates a detail side view of a drive motor.

FIG. 8 illustrates a detail side view of a drive motor 26 and sprocket drive 24. As seen in FIG. 8, motor 26 is positioned above sprocket drive 24 and is rotationally connected by a series of conventional drive shafts and gears (the drive shaft and gears are not visible) to sprocket drive 24. The sprocket drive 24 has around its upper circumference an upper sprocket mount 70 and around its lower circumference a lower sprocket mount 72. Conventional upper sprocket and lower sprocket pieces 28 and 30 (see FIGS. 6 and 7) are mounted in conventional manner on the circumferences of the respective upper sprocket mount 70 and lower sprocket mount 72, as seen previously in FIG. 6 and 7.

Figure 9:
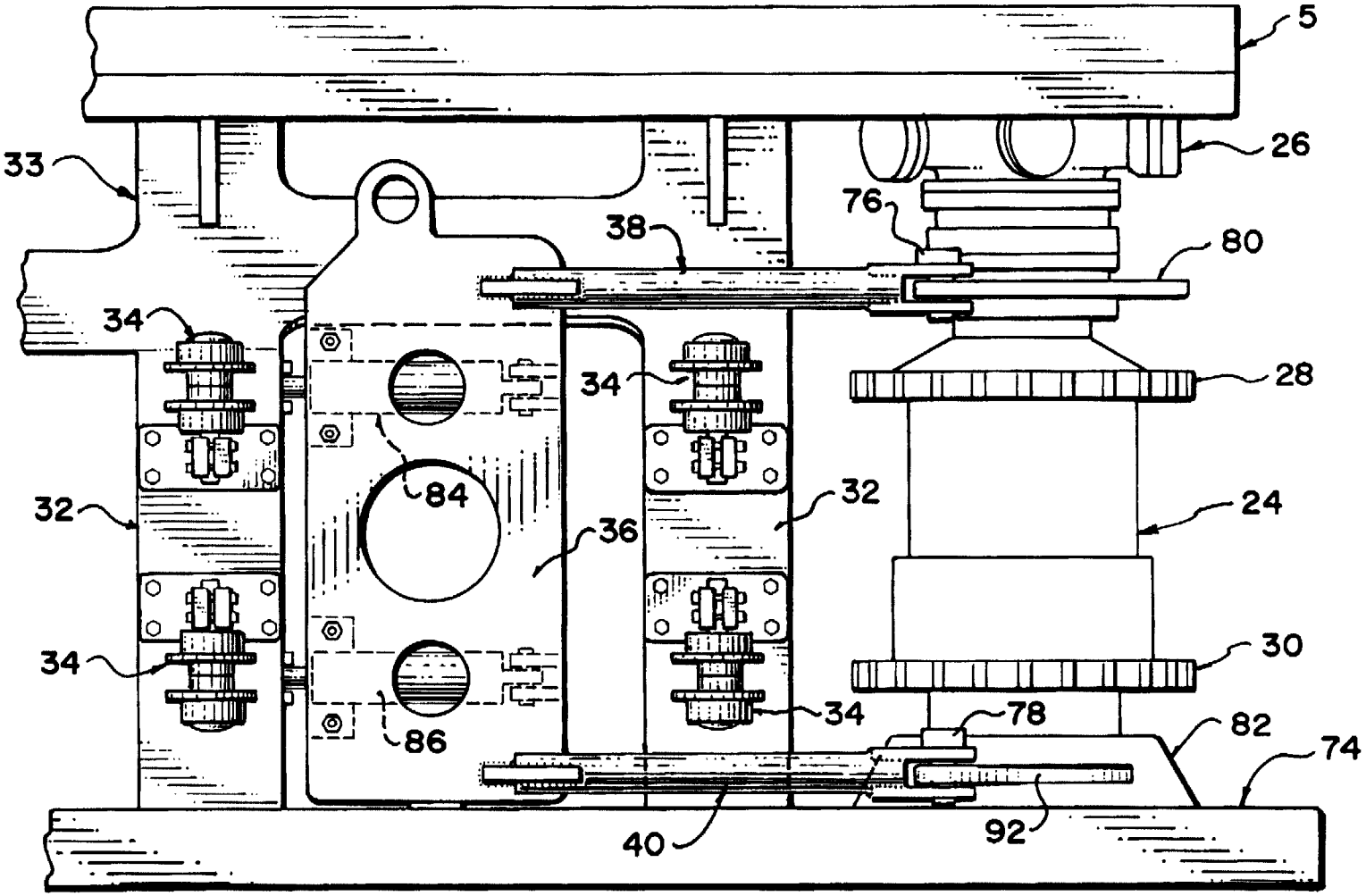
FIG. 9 illustrates a cut-away detail of the right side of the lightweight adjustable blade "Power Dozer", illustrating the drive motor and the alignment mechanism.

FIG. 9 illustrates a cut-away detail of the right side of the lightweight adjustable blade "Power Dozer", illustrating the drive motor 26 and the alignment mechanism. As seen in FIG. 9, the upper and lower regions of the first sprocket drive 24 and motor 26 (the right sprocket drive 24 and motor 26 as seen in FIG. 4) are detachably connected to an upper adjustment arm 38 and a lower adjustment arm 40. The opposite ends of the upper adjustment arm 38 and the lower adjustment arm 40 are permanently connected to the upper and lower ends respectively of hydraulic mount plate 36, which in turn is connected to the frame 32 and upper frame 33 and the bed frame 74. The free end of upper adjustment arm 38, the right end as seen in FIG. 9, is detachably connected to an upper flange 80, which enclosed the upper circumference of sprocket drive 24, and above upper sprocket 28, by means of a disconnectable upper adjustment arm pin 76.

The free end of lower adjustment arm 40, the right end as seen in FIG. 9, is detachably connected to lower adjustable drive mount plate 92 (see FIG. 11, 12 and 13 for details) by removable lower adjustment arm pin 78. The free end of the lower adjustable drive mount plate 92 slides laterally, that is, horizontally, in a horizontal groove formed in slide guide 82.

Figure 10:
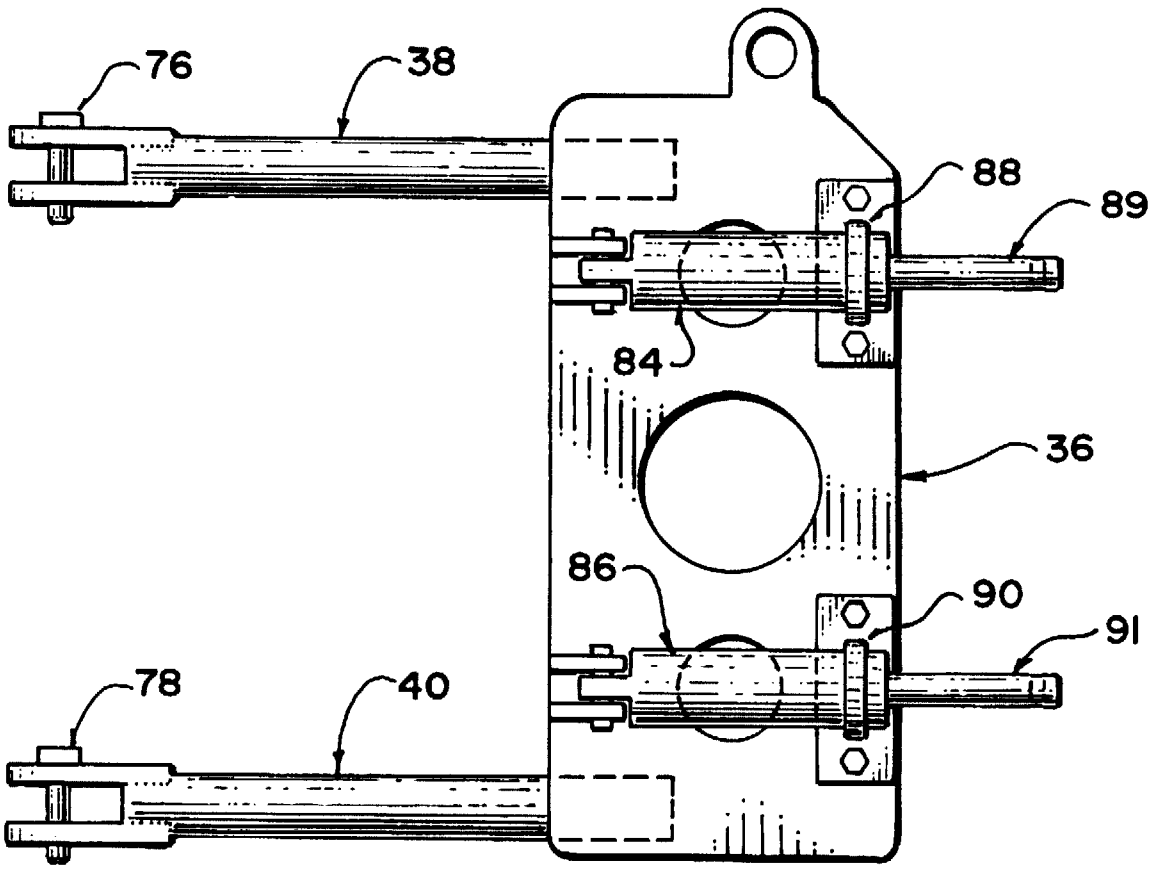
FIG. 10 illustrates a rear view of the upper and lower hydraulic cylinders used for alignment adjustment, mounted on a hydraulic mount plate.

FIG. 10 illustrates a rear view of the upper and lower hydraulic cylinder 84, 86 used for sprocket drive alignment adjustment, mounted on a hydraulic mount plate 36. As seen in FIG. 10, the upper adjustment hydraulic cylinder 84 and the lower adjustment hydraulic cylinder 86 are secured to the rear face of hydraulic mount plate 36, by upper hydraulic cylinder mount 88 and lower hydraulic cylinder mount 90 respectively. Upper piston 39 and lower piston 91 slidably extend respectively from upper cylinder 84 and lower cylinder 86 and when hydraulic pressure is applies to either or both of the cylinders 84, 86, enable the arms 38 and 40 to move the upper and lower ends of the sprocket drive 24, as required. (See FIGS 9 and 11.) As can be seen in FIG. 10, the upper adjustment arm 38 and pin 76 and the lower adjustment arm 40 and lower adjustment arm pin 78 extend to the left, since the rear face of hydraulic mount plate 36, which is the opposite of the view illustrated in FIG. 9 is being viewed.

Figure 11:
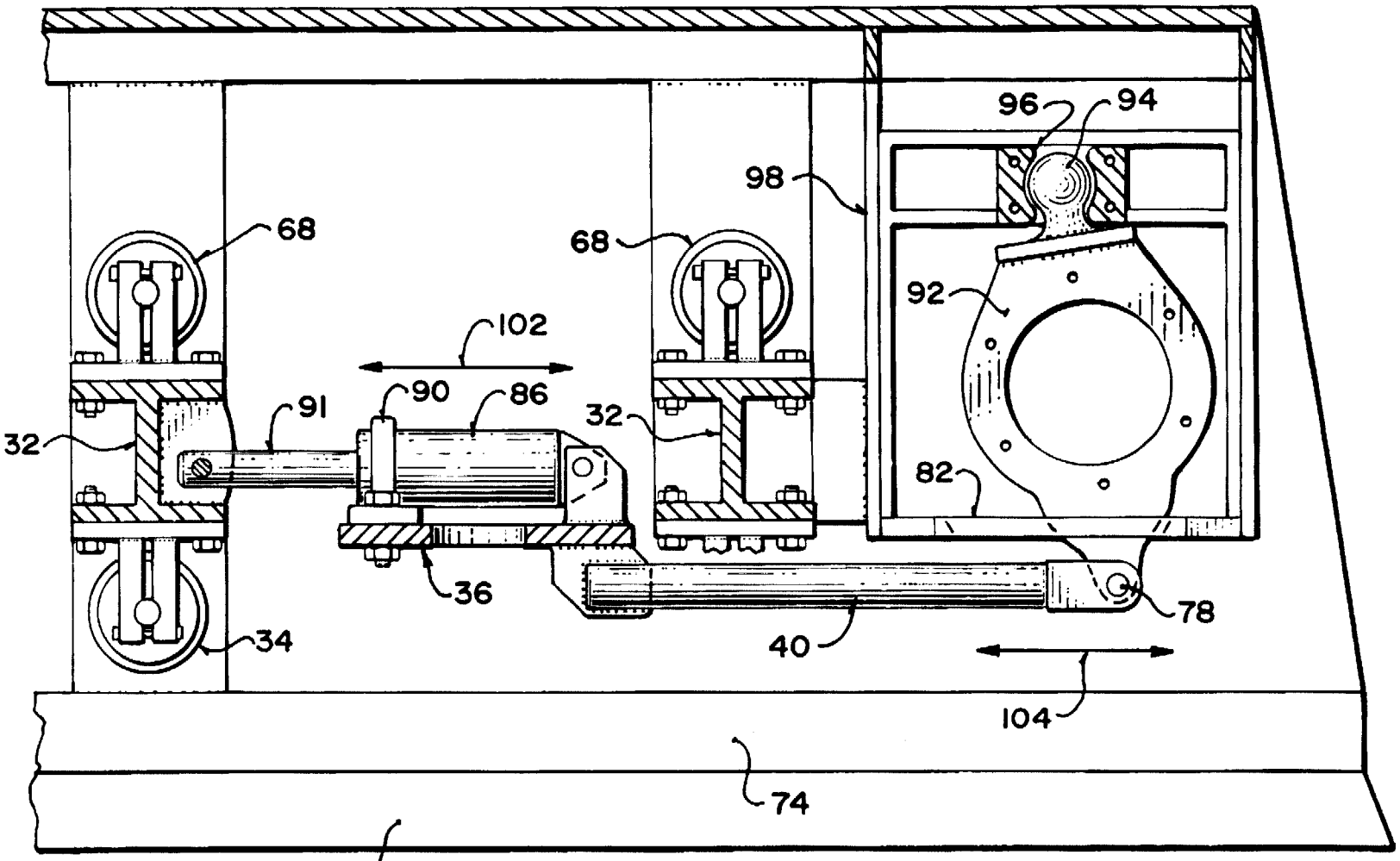
FIG. 11 illustrates a cut-away top view of the lower alignment adjustment mechanism including lower hydraulic cylinder, hydraulic mount plate, lower adjustment arm and lower adjustment drive mount plate.

FIG. 11 illustrates a cut-away top view of the lower alignment adjustment mechanism including lower hydraulic cylinder 86, lower adjustment arm 40, hydraulic mount plate 36, and lower adjustable drive mount plate 92. As seen in FIG. 11, the lower adjustment hydraulic cylinder 86 is connected at one end to hydraulic mount plate by cylinder mount 90, and at the opposite cylinder extension end 91 (the left end as seen in FIG. 11), to vertical support frame 32. Idler wheel 34 is shown at the front side of vertical support frame 32. Hydraulic mount plate 36, in turn, is connected by lower adjustment arm 40 to the pivoting end of lower adjustable drive mount plate 92 by lower adjustment arm pin 78. The proximate end (the lower end as seen in FIG. 11), of lower adjustable mount plate 92, is free to travel (pivot) laterally in the slot of slide guide 82 (as indicated by arrow 104) because the opposite end of lower adjustment drive mount plate 92 has a ball swivel 94 mounted thereon. The ball swivel 94 is rotatably mounted in ball holder 96, which is secured to holder support frame 98. The binding faces of ball 94 and holder 96 are greased for friction reduced movement.

A part of holder support frame 98 is secured to an adjacent vertical support frame 32, and the whole unit rests on and is secured to bed frame 74.

As indicated by the directional arrows 102 and 104, when the piston 91 or lower cylinder 86 is extended or contracted by corresponding application of hydraulic pressure to the cylinder 86, relative to vertical support frame 32, hydraulic mount plate 36 and lower adjustment arm 40 are simultaneously moved. The free end of arm 40 by pin 78 thereby causes lower adjustable drive mount plate 92 to move according to arrow 104. While not seen in FIG. 11 (but see FIG. 9), movement of lower adjustable drive mount plate 92 in turn moves the lower end of sprocket drive 24, either to the left to the right as required in order to ensure that the vertical axial alignment of the first sprocket drive 24 (the right side as seen in FIG 4) corresponds with the vertical alignment of the second sprocket drive 24, as shown at the left in FIG. 4.

This method of adjusting the vertical axial alignment of the first sprocket drive 24 and the second sprocket drive 24, as seen in FIG. 4, is a vast improvement over the fussy and time consuming alignment adjustment methods that had to be followed in adjusting the alignment of the endmost drive motors of the original version of the "Power Dozer". In the present case, according to the invention, fine alignment adjustments can be made in a matter of seconds merely by extending or contracting the ends of pistons 89 or 91 of respective upper and lower hydraulic cylinders 84 and 86. This rapid action of a few seconds, or at most, minutes, compared to hours which were required previously in making alignment adjustments to the original "Power Dozer".

Figure 13:
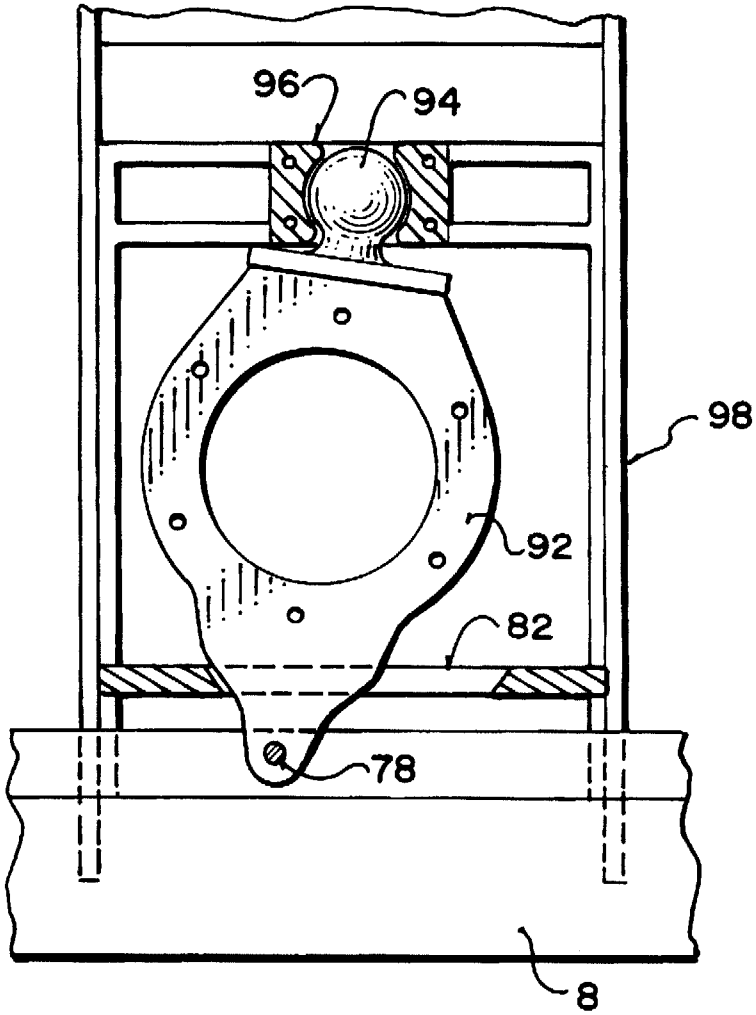
FIG. 13 illustrates a top view of a lower adjustable drive mount plate moved to a leftward position.
Figure 12:
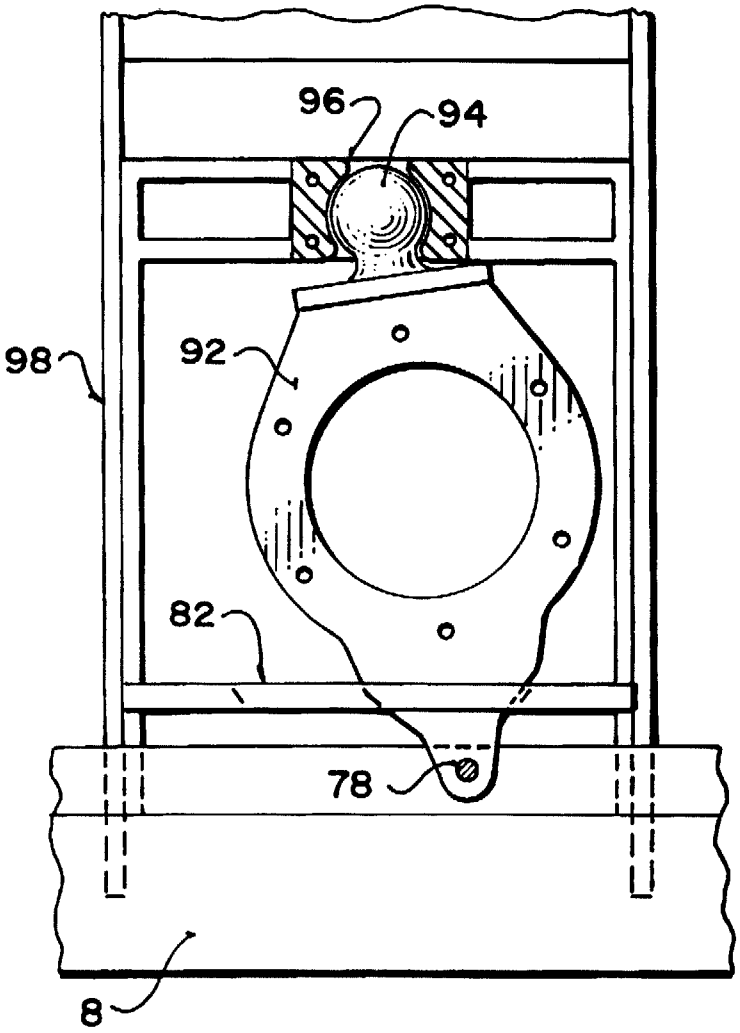
FIG. 12 illustrates a top view of a lower adjustable drive mount plate moved to a rightward position.

FIG. 12 illustrates a top view of a lower adjustable drive mount plate 92 moved to a rightward position. For comparison, FIG. 13 illustrates a top view of a lower adjustment capability of the lower adjustable drive mount plate 92 is about 1-½ track lengths of an endless chain 64. This allows considerable latitude for making alignment adjustments. This will accommodate large degrees of sprocket wear, chain length wear, bushing wear and wear of other components. However, before parts have to be replaces, further adjustments in alignment can be made by removing the horizontal track 6 and then adjusting the telescopic relationship of upper telescope extension arm 46 and lower telescope extension arm 48 (see the left side of FIG 4) by removing upper set pin 50 and lower set pin 52 respectively. Consequently, between the adjustment arm 38, lower adjustment arm 40, upper telescopic adjustment arm 42 and lower telescopic adjustment arm 44, a wide latitude of adjustment capabilities is provided and thus considerable degrees of sprocket wear, bushing wear and wear of other components can be tolerated and accommodated before parts must be replaced.

Figure 14:
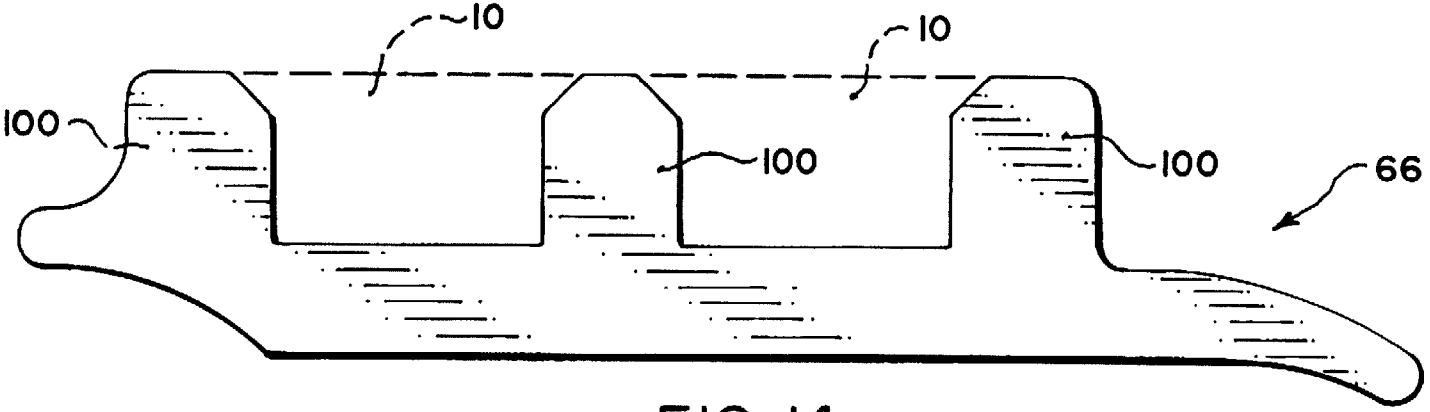
FIG. 14 illustrates a top view of an extruded aluminum lightweight track plate.

To further reduce the overall weight of the "Power Dozer"according to the invention, I have also invented extruded aluminum track plates 66. FIG 14 illustrates a top view of an extruded aluminum track plate 66 (see also FIG. 6). Currently, the track plates for a conventional endless track vehicle are constructed of cast steel, in fixed lengths and widths. These are available for standard widths of tracks on conventional dozers such as Caterpillar Models D7, D8and D9. Since the height of the horizontally moving track 6 on the "Power Dozer" is greater than the standard width of an endless track on a coventional Caterpillar D7, D8 or D9 tractor is was necessary in the original version of the "Power Dozer" to bolt two or more conventional steel track plates in end to end relationship in order to provide a full height for the horizontally travelling track 6. Now, with my extruded aluminum track plate 66, which can be extruded to virtually any length, it is no longer necessary to bolt individual conventional plates together. Futhermore, aluminum is much lighter than steel, yet will withstand the forces that are encountered by the track 6 in moving earth laterally. As seen in FIG. 14, earth moving lugs 100 are formed in the front face of the track plate 66 while it is being extruded. Idle roller inserts (shown in dotted lines but see FIG. 1) can be fitted at the appropriate elevation between the lugs 100. The plates 66 are bolted in series to the exterior sides of track chain 64 (see FIG. 6) to form a completed endless track 6 (see FIG. 1).

As will be apparent to those skilled in the art in the light of the foregoing disclosure, many alterations and modifications are possible in the practice of this invention without departing from the spirit of scope thereof. Accordingly, the scope of the invention is to be construed in accordance with the substance defined by the following claims.

What is claimed is:

1. Apparatus for moving earth comprising:

(a) a vehicle:

(b) earth contacting means mounted on said vehicle for moving earth in one direction;

(c) a reversible horizontally travelling endless track earth moving means mounted in association with said earth contacting means for moving earth laterally to said one direction;

(d) a first and second independent direct drive means driving said endless track earth moving means; and (e) alignment adjusting means located inside the endless track earth moving means and controllable from outside the endless track earth moving means for adjusting alignment of the first independent direct drive means to conform with alignment of the second independent direct drive means.

2. The apparatus as claimed in claim 1 wherein the alignment adjusting means comprises means associated with the first direct drive means, connected to said first direct drive means for moving the first direct drive means relative to the second direct drive means.

3. The apparatus as claimed in claim 2 wherein the alignment adjusting means includes a means associated with the first direct drive means connected to the first direct drive means for moving the first direct drive means relative to the second direct drive means.

4. The apparatus as claimed in claim 2 wherein the alignment adjusting means includes an extension means associated with the second direct drive means, whereby when the extension means is activated, the second direct drive means is moved relative to the first direct drive means.

5. The apparatus as claimed in claim 4 wherein the extension means is connected to a lower region of the second direct drive means and another extension means is connected to an upper region of the second direct drive means.

6. The apparatus as claimed in claim 2 wherein a base of the first direct drive means is associated with a drive means mounting means which can be moved from a first position to a second position.

7. The apparatus as claimed in claim 6 wherein a first end of the drive means mounting means is pivotally connected to a frame of the endless track earth moving means and a second end of the mounting means is free and is movable in association with a guide means connected to the frame.

8. The apparatus as claimed in claim 2 including another alignment adjusting means which is associated with the second direct drive means and moves the second direct drive means relative to the first direct drive means.

9. The apparatus as claimed in claim 1 wherein the alignment adjusting means includes a means associated with the first direct drive means connected to the first direct drive means for moving the first direct drive means relative to the second direct drive means.

10. The apparatus as claimed in claim 1 wherein the alignment adjusting means comprises a first hydraulic cylinder which is secured at one end to a frame of the earth moving means and second end is connected to the first direct drive means.

11. The apparatus as claimed in claim 10 wherein the alignment adjusting means includes a second hydraulic cylinder, the first hydraulic cylinder being extensibly and contractionally connected to a lower region of the first direct drive means and the second hydraulic cylinder being extensibly and contractionally connected to an upper region of the first direct drive means.

12. The apparatus according to claim 1 wherein the horizontally travelling endless track earth moving means presents a substantially vertical face to the direction of horizontal advancement of the vehicle and moves in a horizontal direction laterally to the direction of travel of the vehicle.

13. The apparatus according to claim 12 including rotational restraining means for holding said endless track earth moving means in driving engagement with the first and second direct drive means.

14. The apparatus as claimed in claim 13 wherein the endless track earth moving means is constructed of a plurality of vertical plates connected to upper and lower endless chains, which engage with and travel in upper and lower sprockets on the first and second direct drive means.

15. The apparatus as claimed in claim 14 wherein the plurality of vertical plates are formed of elongated extruded aluminum.

16. The apparatus as claimed in claim 1 including another alignment adjusting means.

* * * * *